US011815859B2

(12) United States Patent
Sato

(10) Patent No.: US 11,815,859 B2
(45) Date of Patent: Nov. 14, 2023

(54) ELECTRONIC WATCH

(71) Applicant: Seiko Epson Corporation, Toyko (JP)

(72) Inventor: Tadashi Sato, Shiojiri (JP)

(73) Assignee: SEIKO EPSON CORPORATION

( * ) Notice: Subject to any disclaimer, the term of this patent is extended or adjusted under 35 U.S.C. 154(b) by 472 days.

(21) Appl. No.: 17/159,503

(22) Filed: Jan. 27, 2021

(65) Prior Publication Data

US 2021/0232098 A1 Jul. 29, 2021

(30) Foreign Application Priority Data

Jan. 28, 2020 (JP) ..... 2020-011417

(51) Int. Cl.
*G04C 3/00* (2006.01)
*G04C 10/00* (2006.01)

(52) U.S. Cl.
CPC ..... *G04C 3/008* (2013.01); *G04C 10/00* (2013.01)

(58) Field of Classification Search
CPC ..... G04C 3/008; G04C 10/00; G04C 3/14; G04G 17/04; H05K 3/303
See application file for complete search history.

(56) References Cited

U.S. PATENT DOCUMENTS 4,186,551 A * 2/1980 Nakayama ..... G04C 3/008 968/452
4,243,329 A * 1/1981 Nakayama ..... G04B 29/04 968/452
4,274,153 A * 6/1981 Kume ..... G04G 5/02 968/452
4,351,040 A * 9/1982 Aoki ..... G04C 3/008 968/452
4,862,432 A * 8/1989 Hiraga ..... G04C 3/008 968/452
5,062,090 A * 10/1991 Komiyama ..... G04C 3/008 368/204
5,416,752 A * 5/1995 Ikegami ..... G04B 29/00 368/316
2003/0198142 A1 10/2003 Yanagisawa

FOREIGN PATENT DOCUMENTS

JP 2003-287582 A 10/2003

* cited by examiner

*Primary Examiner* — Edwin A. Leon

(74) *Attorney, Agent, or Firm* — Harness, Dickey & Pierce, P.L.C.

(57) ABSTRACT

An electronic watch includes an including a package in which an oscillator and a watch control integrated circuit are housed, a circuit board having an elastic function, the circuit board including a first face and a second face, a first member provided with a plurality of first protrusions, and a second member provided with a second protrusion facing the first protrusion with the circuit board interposed therebetween, in which a plurality of clamping positions are clamped between the first protrusion and the second protrusion, A1>P1>A2>0, where A1 is a length of the first protrusion, A2 is a length of the second protrusion, and P1 is a thickness of the oscillation device.

8 Claims, 8 Drawing Sheets

ELECTRONIC WATCH

The present application is based on, and claims priority from JP Application Serial Number 2020-011417, filed Jan. 28, 2020, the disclosure of which is hereby incorporated by reference herein in its entirety.

BACKGROUND

1. Technical Field

The present disclosure relates to an electronic watch.

2. Related Art

In the related art, there is known an electronic watch using a quartz or the like, which includes a crystal oscillator that outputs a clock signal, and an integrated circuit that controls a rotation period of the step motor based on the clock signal, as described in JP 2003-287582 A. In the electronic watch thus configured, terminals of the crystal oscillator housed in a cylindrical case are soldered to be fixed to a circuit board. Further, the crystal oscillator is pressed against a main plate by a hold spring, and fixed so as not to be shifted in position.

In the electronic watch thus configured, the crystal oscillator is pressed against the main plate by the hold spring and fixed so as not to be shifted in position, thus, there is a risk that the crystal oscillator may be subjected to stress, reducing the time accuracy. Moreover, the crystal oscillator adheres to and fixed to the main plate, thus, a large impact that occurs during dropping or the like may be exerted on the crystal oscillator and a fixing structure of the crystal oscillator may be deflected to be a cause of the stress, which reduces the time accuracy.

SUMMARY

An electronic watch includes an oscillation device including a package in which an oscillator and a watch control integrated circuit are housed, a circuit board having an elastic function, the circuit board including a first face and a second face having a front-back relationship with the first face, a first member disposed to face the first face and provided with a plurality of first protrusions, and a second member disposed to face the second face and provided with a second protrusion facing the first protrusion with the circuit board interposed therebetween, in which the oscillation device is mounted at the first face of the circuit board, a plurality of clamping positions at a predetermined distance in an outward direction from an outer edge of the oscillation device are clamped between the first protrusion and the second protrusion, A1>P1>A2>0, where A1 is a length of the first protrusion, A2 is a length of the second protrusion, and P1 is a thickness of the oscillation device, and a gap is formed on a side of the first face of the circuit board so that a minimum distance between the first face and the first member is not less than the length A1 and a gap is formed on a side of the second face of the circuit board so that a minimum distance between the second face and the second member is not less than the length A2.

Another electronic watch includes an oscillation device including a package in which an oscillator and a watch control integrated circuit are housed, a circuit board having an elastic function, the circuit board including a first face and a second face having a front-back relationship with the first face, a first member provided with a plurality of first protrusions, a second member provided with a second protrusion facing the first protrusion with the circuit board interposed therebetween, and a third member disposed to face the first face and a fourth member disposed to face the second face, in which a plurality of clamping positions at a predetermined distance in an outward direction from an outer edge of the oscillation device are clamped between the first protrusion and the second protrusion, A1>P1>A2>0, where A1 is a length of the first protrusion, A2 is a length of the second protrusion, and P1 is a thickness of the oscillation device, and a gap is formed on a side of the first face of the circuit board so that a minimum distance between the first face and the third member is not less than the length A1 and a gap is formed on a side of the second face of the circuit board so that a minimum distance between the second face and the fourth member is not less than the length A2.

DESCRIPTION OF EXEMPLARY EMBODIMENTS

1. First Embodiment

A watch 1 as an electronic watch according to the first embodiment will be described with reference to FIGS. 1 to 6. Note that, in FIG. 6, a cross-sectional view is given omitting an illustration of the interior of the oscillation device, for convenience of explanation.

The watch 1 is a quartz watch, and is a wristwatch including a power source, which causes hands to indicate the clock time.

Figure 1:
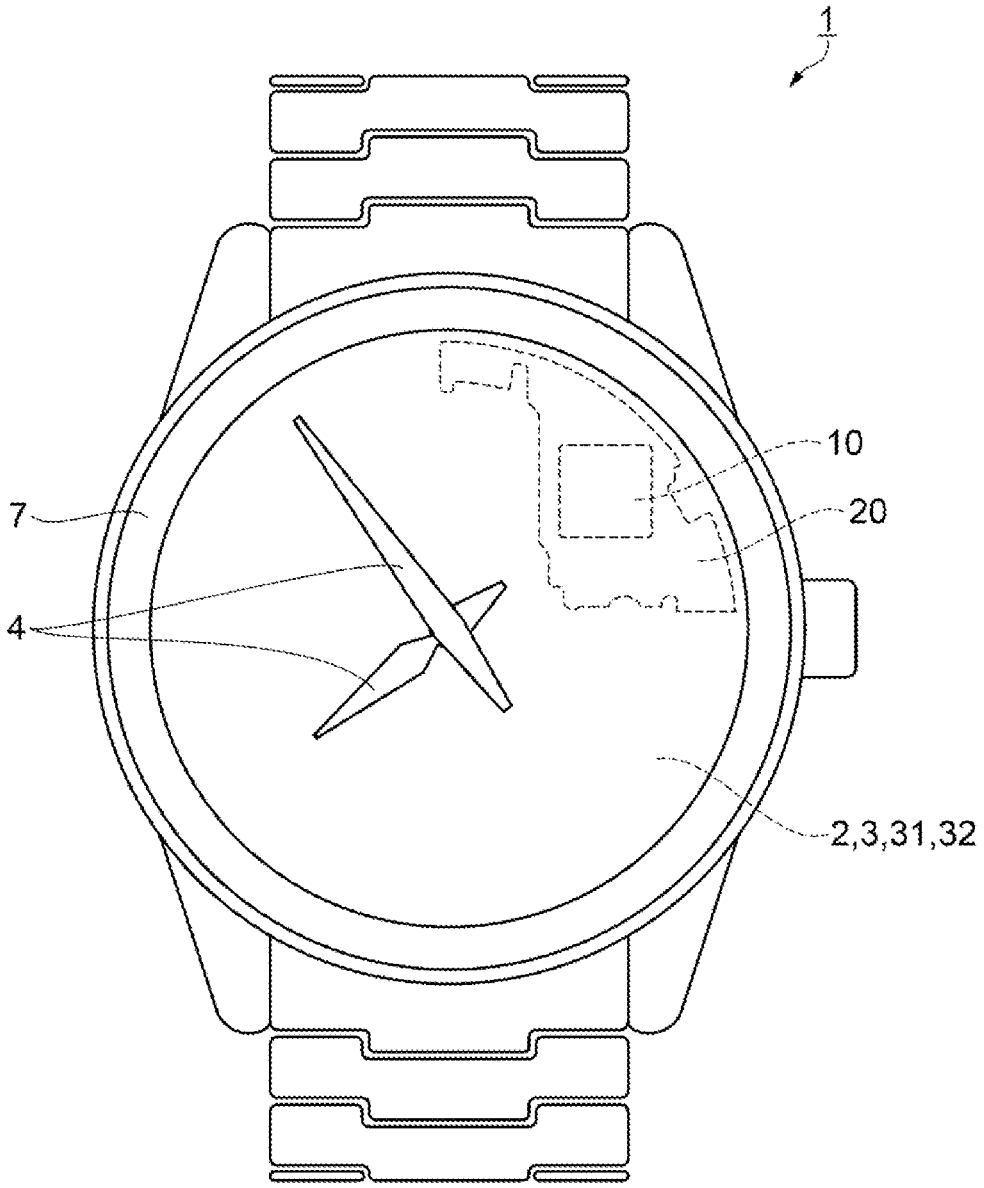
FIG. 1 is a plan view schematically illustrating a watch according to a first embodiment.
Figure 2:
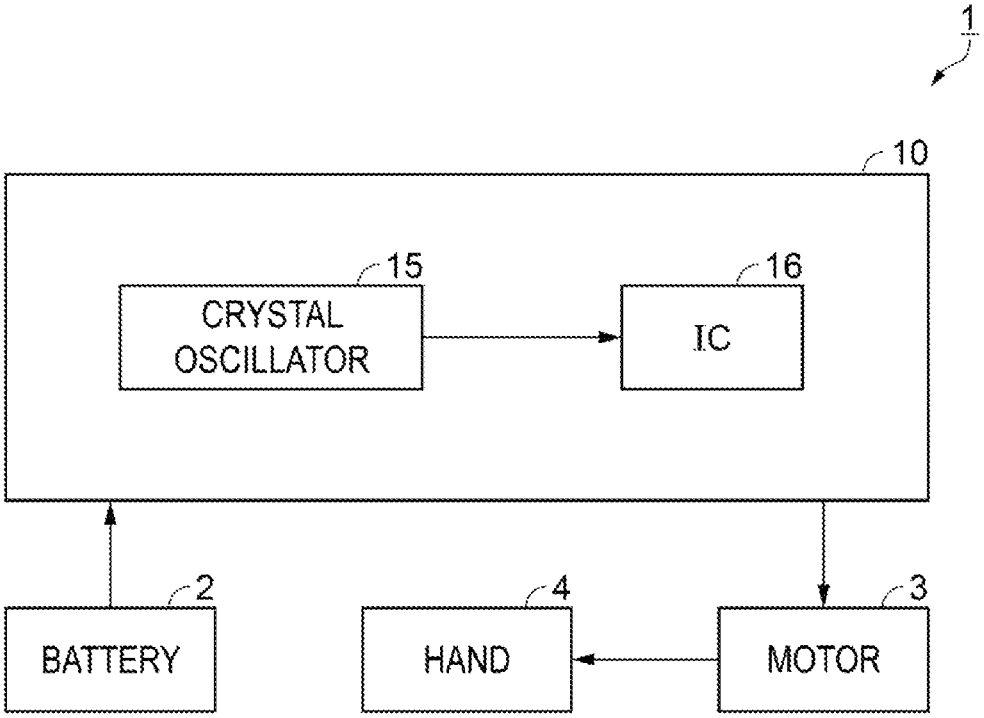
FIG. 2 is a configuration view schematically illustrating a watch according to a first embodiment.
Figure 3:
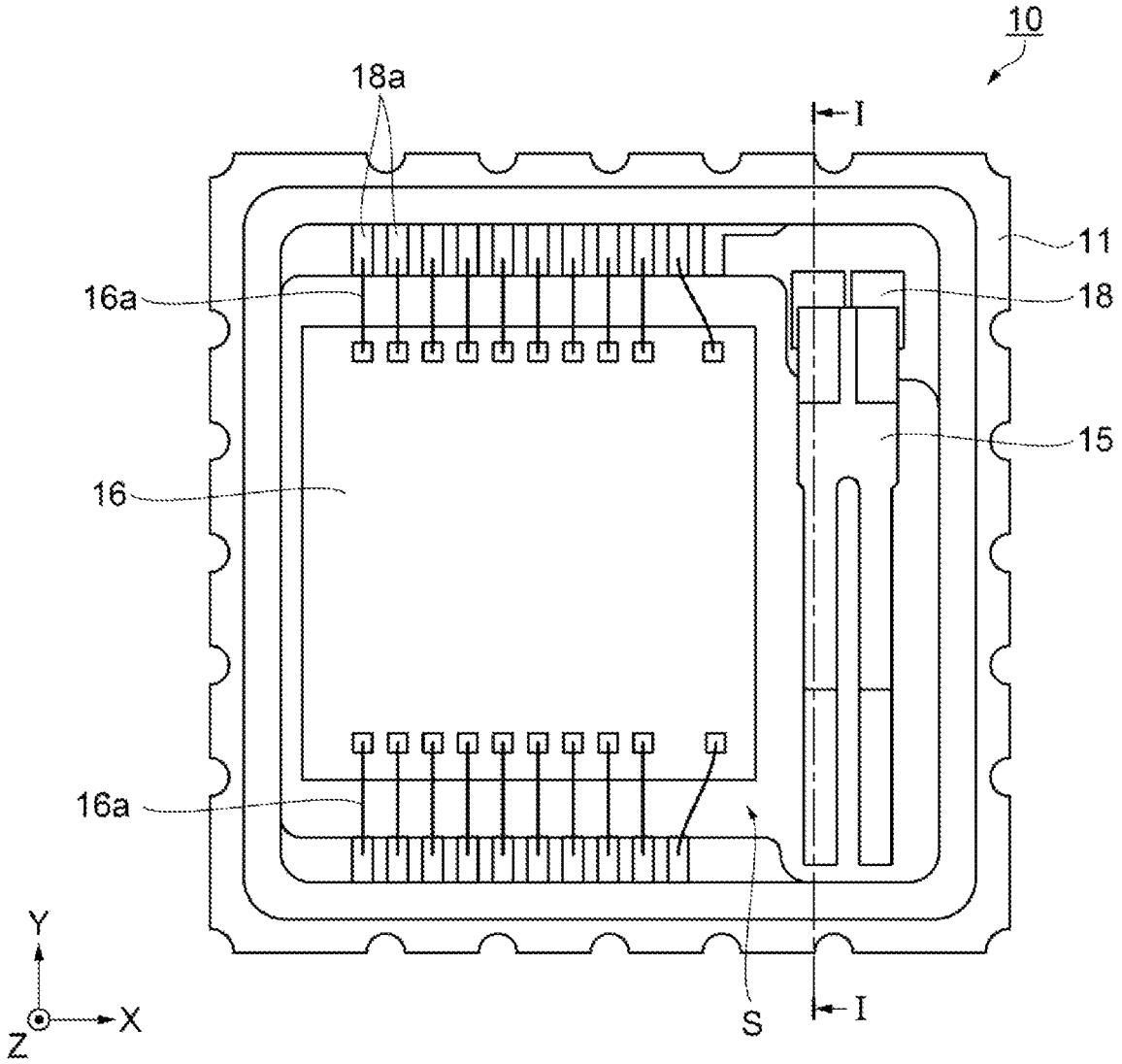
FIG. 3 is a plan view of an oscillation device.

As illustrated in FIGS. 1 to 3, the watch 1 includes a battery 2 as an energy source, a motor 3 that generates torque, a hour hand that indicates the clock time, a hand 4 that is a minute hand, and an oscillation device 10 in which a crystal oscillator 15 as an oscillator and an IC 16 as a watch control integrated circuit are housed in a package 11, a circuit board 20 on which the oscillation device 10 is mounted, a first member 31 that clamps the circuit board 20 and a second member 32, and a case 7 that houses these members.

Figure 4:
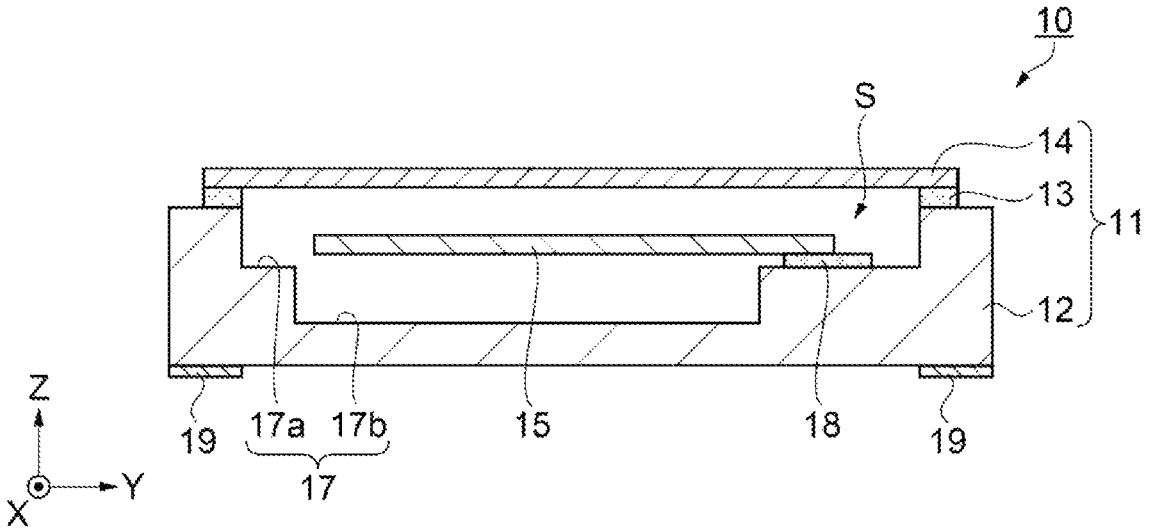
FIG. 4 is a cross-sectional view taken along line I-I of an oscillation device illustrated in FIG. 3.

The oscillation device 10 is described with reference to FIGS. 3 and 4. Note that FIG. 3 is a plan view that is viewed through a lid 14, for convenience of explanation. FIG. 4 is a cross-sectional view taken along line I-I in FIG. 3. The oscillation device 10 includes the package 11, and the crystal oscillator 15 and the IC 16 that are housed in the package 11. The package 11 has a substantially rectangular shape of a 5 mm square in plan view. The package 11 includes a base 12 provided with a concave portion 17 that opens at an upper face in a +Z direction, and the lid 14 jointed to the upper face of the base 12 via a seal member 13 in a manner closing up the opening of the concave portion 17. An internal space S is formed inside the package 11 by the concave portion 17, where the internal space S houses the crystal oscillator 15 and the IC 16. For example, the base 12 can be composed of ceramic such as alumina, and the lid 14 can be composed of a metal material such as kovar. However, constituent materials of the base 12 and the lid 14 are not limited to those described above.

The internal space S is airtight, and is in a state of reduced pressure or a state close to a vacuum. This allows the viscosity resistance to be reduced, improving oscillation characteristics of the crystal oscillator 15. However, an atmosphere of the internal space S is not particularly limited, where the atmosphere may be in an atmospheric pressure state filled with an inert gas such as nitrogen, for example.

Here, a direction from the crystal oscillator 15 or the IC 16 toward a face of the lid 14 is designated as the +Z direction, a direction that is orthogonal to the +Z direction and headed from the IC 16 toward the crystal oscillator 15 as a +X direction, and further, a direction that is orthogonal to the +Z direction and the +X direction and headed from an oscillation piece toward a base portion in the crystal oscillator 15 as a +Y direction.

The concave portion 17 is constituted by a first concave portion 17*a* and a second concave portion 17*b* that are aligned side by side in a Z direction. The first concave portion 17*a*, which is larger in size than the second concave portion 17*b* when viewed in a cross-sectional view in a direction orthogonal to the +Z direction, is provided between the lid 14 and the second concave portion 17*b* in a Z-axis direction. In addition, the second concave portion 17*b*, which is smaller in size than the first concave portion 17*a*, is provided between the base 12 and the first concave portion 17*a* in the Z-axis direction. Further, the crystal oscillator 15 is provided at the first concave portion 17*a*, and the IC 16 is provided at the second concave portion 17*b*.

Moreover, a plurality of internal terminals 18 and 18*a* are arranged at a bottom face of the first concave portion 17*a*, and a plurality of external terminals 19 are arranged at a lower face of the base 12 on a side opposite to an upper face at which the concave portion 17 is formed. The internal terminals 18 are electrically coupled with the external terminals 19 via non-illustrated wirings formed inside the base 12.

The internal terminals 18 are also electrically coupled with the crystal oscillator 15 via a non-illustrated electrically conductive bonding material, and the internal terminals 18*a* are electrically coupled with the IC 16 via bonding wires 16*a*. The internal terminals 18 are electrically coupled with the internal terminals 18*a* via non-illustrated wirings formed inside the base 12.

The crystal oscillator 15 is an oscillation piece of a tuning fork-like shape, and is constituted by a Z-cut crystal substrate or the like. In the first embodiment, the crystal oscillator 15 has a cantilever beam structure, where the base portion of the crystal oscillator 15 is fixed to the bottom face of the first concave portion 17*a* via the non-illustrated electrically conductive bonding material. The IC 16 is configured to excite the crystal oscillator 15 to correct acquired data, and to then output the data via the external terminals 19 provided at the oscillation device 10.

Figure 5:
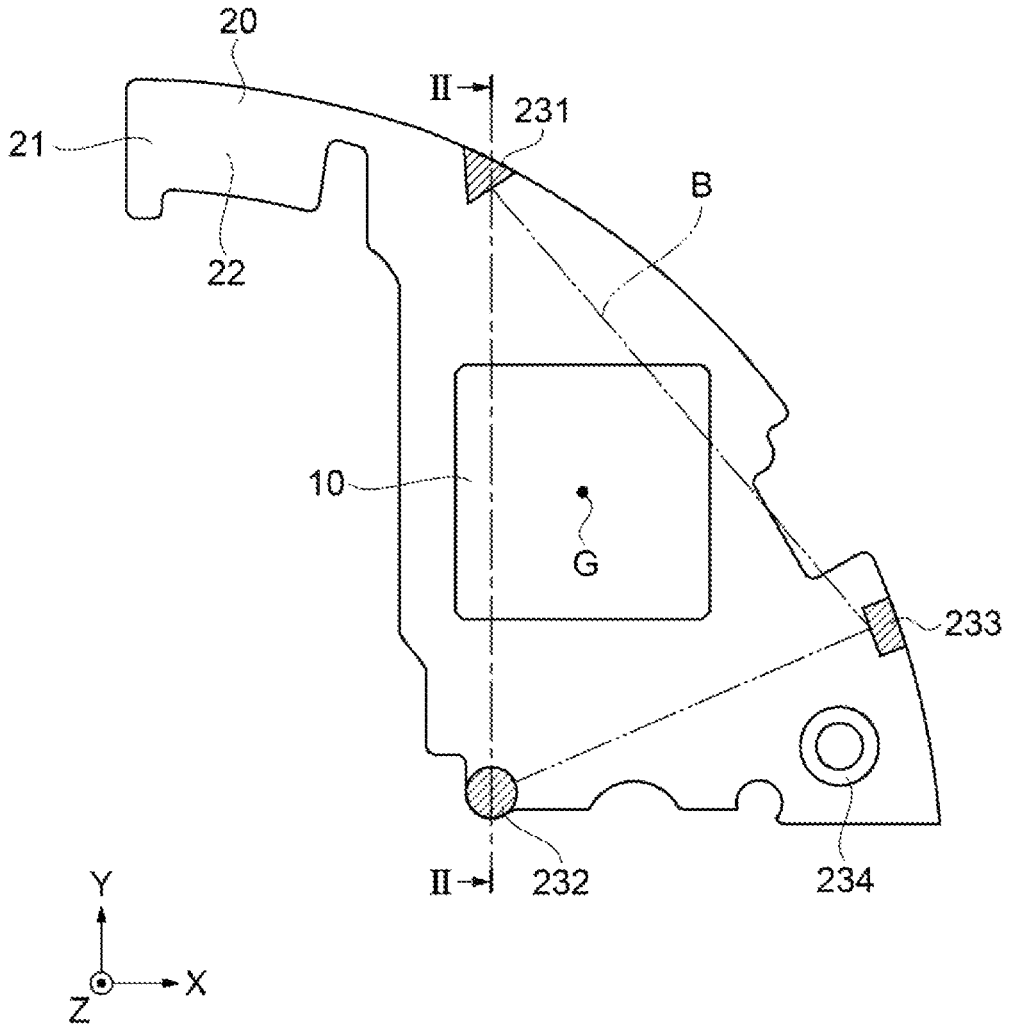
FIG. 5 is a plan view of a circuit board.
Figure 6:
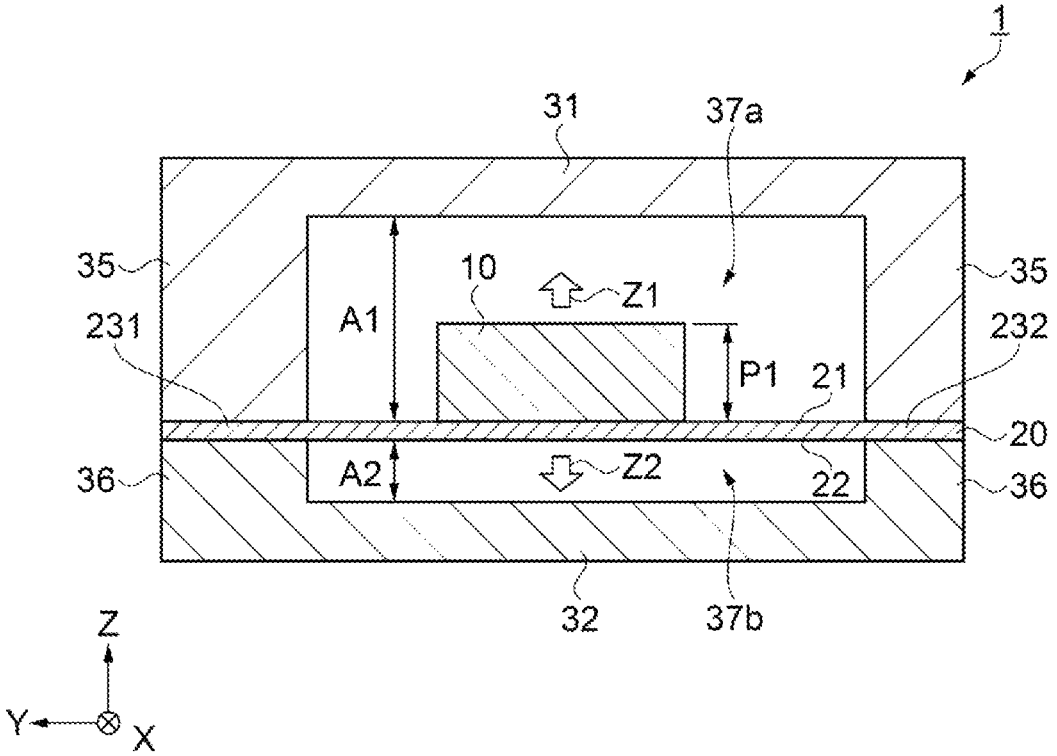
FIG. 6 is a cross-sectional view along line II-II of a circuit board according to a first embodiment.

The circuit board 20 housed inside the case 7 of the watch 1, which is illustrated in FIG. 1, includes a first face 21, and a second face 22 having a front-back relationship with the first face 21, as illustrated in FIGS. 5 and 6. In the circuit board 20, the oscillation device 10 is mounted at the first face 21 and non-illustrated terminals provided at the first face 21 are electrically coupled with the external terminals 19 of the oscillation device 10. Note that the circuit board 20, which includes a flexible substrate, can cause the elastic function to absorb and release an impact received from an outside.

Inside the case 7 of the watch 1, the first member 31 provided with three pieces of first protrusions 35 is disposed facing the first face 21 of the circuit board 20, and further, the second member 32 provided with three pieces of second protrusions 36 is disposed facing the second face 22 of the circuit board 20. The first member 31 has a flat-plate shape and functions as a receptacle. Also, the second member 32 has a flat-plate shape and functions as a main plate.

The three pieces of first protrusions 35, which are provided to protrude from an identical face of the first member 31 toward the first face 21 of the circuit board 20, have a columnar shape such as a circular cylinder shape or a triangular prism shape. Assuming that an end on a side of the first member 31 of the first protrusion 35 is a base end and an end on a side of the first face 21 of the first protrusion 35 is a leading end, a length A1 from the base end to the leading end in the Z direction of the first protrusion 35 exceeds a thickness P1 of the oscillation device 10, where A1>P1 is established. Specifically, the length A1 is 1.72 mm and the thickness P1 is 1.3 mm.

The three pieces of second protrusions 36, which are provided to protrude from an identical face of the second member 32 toward the second face 22 of the circuit board 20, have a columnar shape such as a circular cylinder shape or a triangular prism shape. Assuming that an end portion on a side of the second member 32 of the second protrusion 36 is a base end and an end portion on a side of the second face 22 of the second protrusion 36 is a leading end, a length A2 from the base end to the leading end in the Z direction of the second protrusion 36 exceeds 0 mm and falls below the thickness P1 of the oscillation device 10, where P1>A2>0 is established. Specifically, the length A2 is 0.12 mm.

The three pieces of first protrusions 35 and the three pieces of second protrusions 36 face each other, with the circuit board 20 interposed therebetween, at clamping positions 231, 232, and 233 at a predetermined distance in an outside direction from an outer edge of the oscillation device 10 that is mounted on the circuit board 20, and clamp the circuit board 20. Specifically, the outside direction is a direction, in an XY plane, from the oscillation device 10 toward an outer edge of the circuit board 20, and the predetermined distance is approximately 3 mm.

Accordingly, the watch 1 includes, on the side of the first face 21 of the circuit board 20, a gap 37*a* where the minimum distance between the first face 21 and the first member 31 is equal to the length A1, and includes, on the side of the second face 22 of the circuit board, a gap 37*b* where the minimum distance between the second face 22 and the second member 32 is equal to the length A2. According to the above, a length in the Z direction of the gap 37*a* exceeds the thickness P1 of the oscillation device 10, and a length in the Z direction of the gap 37*b* exceeds 0 mm and falls below the thickness P1 of the oscillation device 10.

The clamping positions 231, 232, and 233 are, at the circuit board 20, at the predetermined distance in the outside direction from the outer edge of the oscillation device 10, and are arranged such that a region B formed by connecting the clamping positions 231, 232, and 233 overlaps with a gravity center G of the oscillation device 10, when viewed in the +Z direction.

The clamping positions 231, 232, and 233 in the first embodiment have a substantially triangular, circular, and quadrilateral shape, where shapes and areas of the clamping positions are not particularly limited. Any setting can be applied according to a layout inside the watch.

Further, in the first embodiment, the description has been given with the clamping positions 231, 232, and 233 that are provided in three positions, however, it suffices that the clamping positions be provided in at least three positions, and a clamping position may be provided at a position separated by a predetermined distance or greater, in addition to the clamping positions 231, 232, and 233. According to the above, four pieces of the clamping positions are provided including a clamping position 234.

In mounting the crystal oscillator 15 and the IC 16 onto the circuit board 20, the oscillation device 10 having an integrated form, in which the crystal oscillator 15 and the IC 16 are housed, becomes larger in size than a cylindrical case that houses only the crystal oscillator 15, resulting in an increase in weight as well. Accordingly, when the oscillation device 10 is caused to adhere to and fixed to the main plate (the second member 32), there is a risk that a large impact may be exerted, during dropping, on the oscillation device 10, which may lead to a damage to the crystal oscillator 15, or a reduction in accuracy. Under such a circumstance, the watch 1 of the first embodiment, has a structure in which the circuit board 20 on which the oscillation device 10 is mounted is clamped between the first protrusions 35, and the second protrusions 36 that protrude from the main plate. Specifically, the clamping positions 231, 232, and 233 at the circuit board 20 are clamped between the three pieces of first protrusions 35 and the three pieces of second protrusions 36. Such a structure allows the watch 1 to hold the oscillation device 10 without making the oscillation device in contact with the circumjacent members other than the circuit board 20, suppressing the impact from being transmitted to the oscillation device 10.

The watch 1 can also include the gap 37*a* and the gap 37*b* in the Z direction of the oscillation device 10 due to the configuration in which the oscillation device 10 is mounted on the circuit board 20 that is clamped between the three pieces of first protrusions 35 and the three pieces of second protrusions 36.

In the watch 1 thus configured, when an impact is exerted to the watch 1 due to a dropping or the like, the oscillation device 10 swings in a direction of an arrow Z1 or a direction of an arrow Z2, and thus the swinging absorbs a stress of the impact. Further, the oscillation device 10 that swings, which includes the gap 37*a* and the gap 37*b* in the Z direction, is prevented from colliding with the first member 31 and the second member 32, making it possible to reduce an influence of the impact on the crystal oscillator 15 that is housed in the oscillation device 10.

This allows for the mounting of the oscillation device 10 that hardly has an influence derived from an impact such as a pressing force or a dropping on the crystal oscillator 15, to thus provide the watch 1 with high accuracy.

2. Second Embodiment

Figure 7:
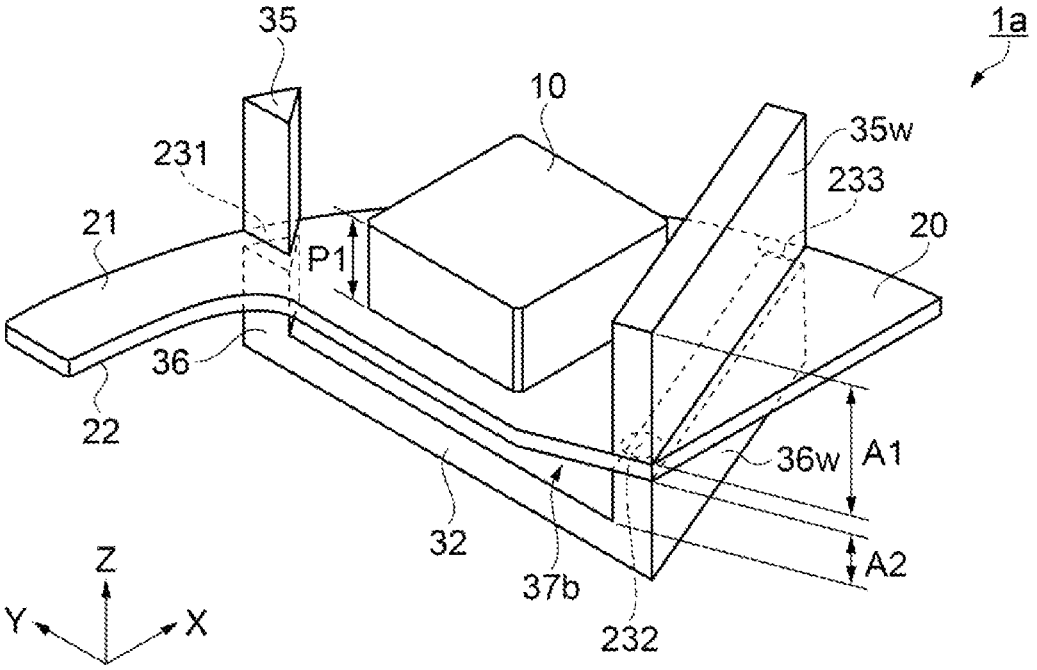
FIG. 7 is a perspective view of a circuit board according to a second embodiment.

Next, a watch 1*a* according to the second embodiment will be described with reference to FIG. 7. Note that identical constituents s as in the first embodiment are denoted by identical reference signs, and the redundant descriptions will be omitted.

The watch 1 of the first embodiment includes the three pieces of first protrusions 35 and the three pieces of second protrusions 36. In place of this, the watch 1*a* of the second embodiment includes, the first protrusion 35, a first protrusion 35*w*, the second protrusion 36, and a second protrusion 36*w*.

The first protrusion 35 and the first protrusion 35*w* are provided to protrude from an identical face of the first member 31 toward the first face 21 of the circuit board 20, and one piece of the first protrusion 35*w* serves as a wall shaped protrusion configured to clamp over two pieces of the clamping positions 232 and 233 among the three pieces of the clamping positions 231, 232, and 233. Assuming that, on the normal line overlapping with the clamping position 232 or the clamping position 233, an end on the side of the first member 31 of the first protrusion 35*w* is designated as a base end and an end on the side of the first face 21 of the first protrusion 35*w* is designated as a leading end, the lengths A1 from the base ends to the leading ends in the Z direction of the first protrusions 35 and 35*w* exceed the thickness P1 of the oscillation device 10, where A1>P1 is established. Specifically, the length A1 is 1.72 mm and the thickness P1 is 1.3 mm.

Also, the second member 32 is provided with the second protrusion 36 and the second protrusion 36*w*. The second protrusion 36 and the second protrusion 36*w* are provided to protrude from an identical face of the second member 32 toward the second face 22 of the circuit board 20, and one piece of the second protrusion 36*w* serves as a wall shaped protrusion configured to clamp over the two pieces of the clamping positions 232 and 233 among the three pieces of the clamping positions 231, 232, and 233. Assuming that, on the normal line overlapping with the clamping position 232 or the clamping position 233, an end on the side of the second member 32 of the second protrusion 36*w* is designated as a base end and an end on the side of the second face 22 of the second protrusion 36*w* is designated as a leading end, the lengths A2 from the base ends to the leading ends in the Z direction of the second protrusions 36 and 36*w* exceed 0 mm and fall below the thickness P1 of the oscillation device 10, where P1>A2>0 is established. Specifically, the length A2 is 0.12 mm.

In the circuit board 20 housed inside the case 7 of the watch 1*a*, the clamping position 231 is clamped between the first protrusion 35 and the second protrusion 36, and the clamping positions 232 and 233 are clamped between the first protrusion 35*w* and the second protrusion 36*w*.

Accordingly, in the watch 1*a*, the circuit board 20 on which the oscillation device 10 is mounted is clamped over a larger area than in the first embodiment, thus allowing the oscillation device 10 to be held stably without being in contact with the circumjacent members.

Further, in the watch 1*a* of the second embodiment, the circuit board 20, which has a double-end fixed beam structure as in the watch 1, allows the oscillation device 10 to be held without receiving a pressing force. The oscillation device 10, which includes the gap 37*a* on the side of the first face 21, and the gap 37*b* on the side of the second face 22, is prevented from colliding with the first member 31 and the second member 32, making it possible to reduce the influence of the impact on the crystal oscillator 15 that is housed in the oscillation device 10.

3. Third Embodiment

Figure 8:
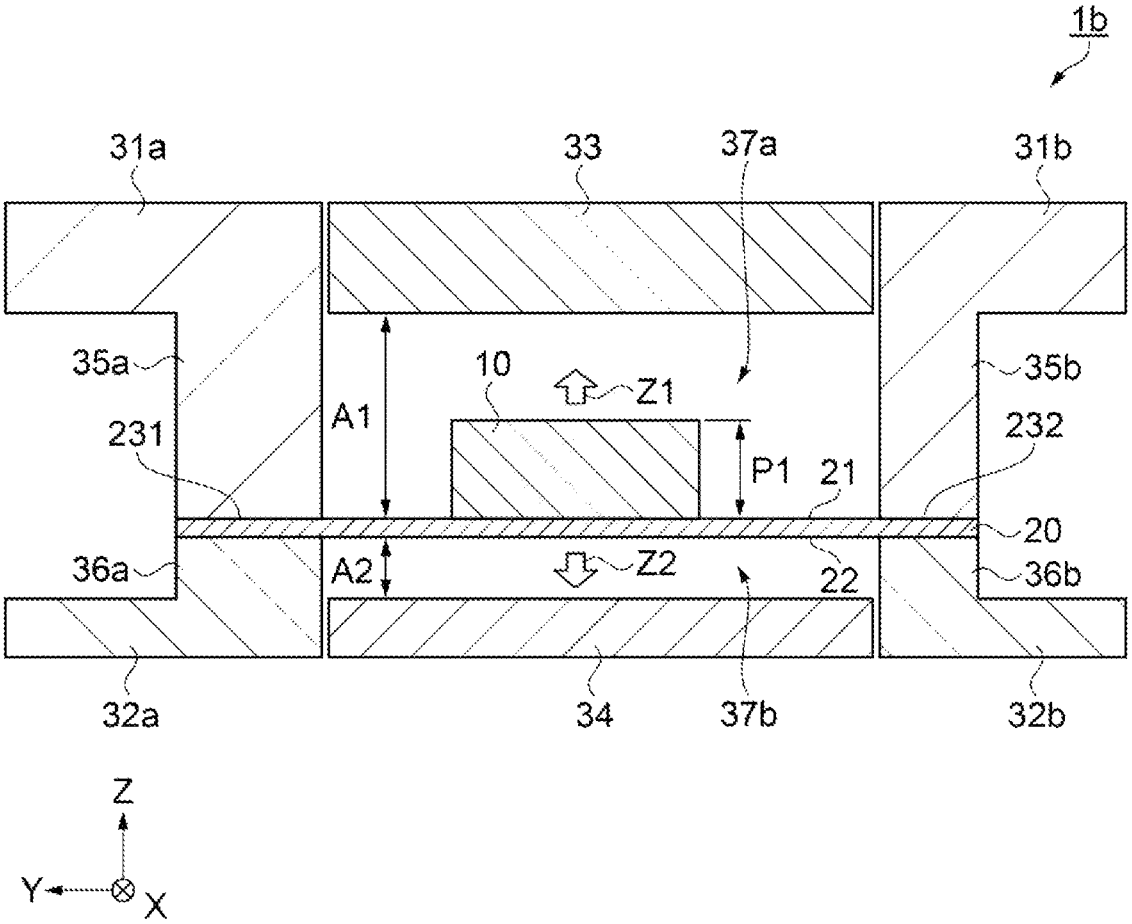
FIG. 8 is a cross-sectional view of a circuit board according to a third embodiment at an identical position as in FIG. 6.

Next, a watch 1*b* according to the third embodiment will be described with reference to FIG. 8. Note that, in FIG. 8, a cross-sectional view is given omitting an illustration of the interior of the oscillation device 10 for convenience of explanation, and identical constituents as in the first embodiment are denoted by identical reference signs, and the redundant descriptions will be omitted.

In the watch 1 of the first embodiment, the first member 31 provided with the three pieces of first protrusions 35 is disposed facing the first face 21 of the circuit board 20, and further the second member 32 provided with the three pieces of second protrusions 36 is disposed facing the second face 22 of the circuit board 20. A first member of the watch 1*b* of the third embodiment is constituted by members 31*a* and 31*b* as first constituent members, and a second member is constituted by members 32*a* and 32*b* as second constituent members. Further, the members 31*a*, 31*b*, 32*a*, and 32*b* are arranged at positions that do not overlap with the oscillation device 10 when viewed in the +Z direction.

Inside a case of the watch 1*b*, there are provided, facing the first face 21 of the circuit board 20, the member 31*a* provided with two pieces of first protrusions 35*a* facing the clamping position 231 and the non-illustrated clamping position 233 respectively, the member 31*b* provided with a first protrusion 35*b* facing the clamping position 232, and a third member 33 between the member 31*a* and the member 31*b*. The member 31*a* and the member 31*b* are composed of separate parts, and function as a receptacle.

The two pieces of first protrusions 35*a* are provided to protrude from a face in a −Z direction of the member 31*a* toward the first face 21, and the first protrusion 35*b* is provided to protrude from a face in the −Z direction of the member 31*b* toward the first face 21, where the first protrusions 35*a* and the first protrusion 35*b* have a columnar shape such as a circular cylinder shape or a triangular prism shape. Assuming that an end on a side of the member 31*a* of the first protrusion 35*a* is a base end and an end on the side of the first face 21 of the first protrusion 35*a* is a leading end and an end on a side of the member 31*b* of the first protrusion 35*b* is a base end and an end on the side of the first face 21 of the first protrusion 35*b* is a leading end, the lengths A1 from the base ends to the leading ends in the Z direction of the first protrusions 35*a* and 35*b* exceed the thickness P1 of the oscillation device 10, where A1>P1 is established. Specifically, the length A1 is 1.72 mm.

Further, inside the case of the watch 1*b*, there are provided, facing the second face 22 of the circuit board 20, the member 32*a* provided with two pieces of second protrusions 36*a*, the member 32*b* provided with a second protrusion 36*b*, and a fourth member 34 between the member 32*a* and the member 32*b*. The member 32*a* and the member 32*b* are composed of separate parts and function as the main plate or a second plate.

The two pieces of second protrusions 36*a* are provided to protrude from a face in the +Z direction of the member 32*a* and the second protrusion 36*b* is provided to protrude from a face in the +Z direction of the member 32*b* toward the second face 22, where the second protrusion 36*a* and the second protrusion 36*b* have a columnar shape such as a circular cylinder shape or a triangular prism shape. Assuming that an end on a side of the member 32*a* of the second protrusion 36*a* is a base end and an end on the side of the second face 22 of the second protrusion 36*a* is a leading end and an end on a side of the member 32*b* of the second protrusion 36*b* is a base end an end on the side of the second face 22 of the second protrusion 36*b* is a leading end, the lengths A2 from the base ends to the leading ends in the Z direction of the second protrusions 36*a* and 36*b* exceed 0 mm and fall below the thickness P1 of the oscillation device 10, where P1>A2>0 is established. Specifically, the length A2 is 0.12 mm.

The two pieces of first protrusions 35*a* and the second protrusion 36*a*, and the two pieces of the first protrusions 35*b* and the second protrusion 36*b* face each other, with the circuit board 20 interposed therebetween, at the clamping positions 231, 232, and 233 at the predetermined distance in the outside direction from the outer edge of the oscillation device 10 of a 5 mm square that is mounted on the circuit board 20, where the clamping positions 231 and 232 are clamped between the two pieces of first protrusions 35*a* and the two pieces of second protrusions 36*a*. Further, the clamping position 232 is clamped between the first protrusion 35*b* and the second protrusion 36*b*, thus the circuit board 20 is clamped. Specifically, the outside direction is a direction along the XY plane, and the predetermined distance is approximately 3 mm.

The third member 33 is disposed to face, via the length A1, the first face 21, and the fourth member 34 is disposed to face, via the length A2, the second face 22. Accordingly, the watch 1*b* includes the gap 37*a* where the minimum distance between the first face 21 and the third member 33 is the length A1, and the gap 37*b* where the minimum distance between the second face 22 and the fourth member 34 is the length A2. According to the above, the length in the Z direction of the gap 37*a* exceeds the thickness P1 of the oscillation device 10, and the length in the Z direction of the gap 37*b* exceeds 0 mm and falls below the thickness P1 of the oscillation device 10.

Accordingly, in the watch 1*b*, the circuit board 20 on which the oscillation device 10 is mounted, which is fixed at the three pieces of the clamping positions 231, 232, and 233, has a double-end fixed beam structure, where the oscillation device 10 is held without being in contact with the circumjacent members other than the circuit board 20.

Further, in the watch 1*b* of the third embodiment, the circuit board 20. which also has a double-end fixed beam structure as in the watches 1 and 1*a*, allows the oscillation device 10 to be held without receiving a pressing force. The oscillation device 10, which includes the gap 37*a* on the side of the first face 21, and the gap 37*b* on the side of the second face 22, is prevented from colliding with the third member 33 and the fourth member 34, making it possible to reduce the influence of the impact on the crystal oscillator 15 that is housed in the oscillation device 10.

In the first to third embodiments described above, a quartz wristwatch is described as an example, and the present disclosure is not limited to this example. The present disclosure can be applied to various watches, such as a spring drive as an electronically controlled mechanical watch, and a solar watch with power generation function.

Although the description has been given exemplifying the crystal oscillator 15 of a tuning fork-type oscillator as an oscillator, and the present disclosure is not limited to this example. An AT oscillator or a MEMS oscillator can be used as the oscillator.

In the embodiments described above, a layout is employed in which the crystal oscillator 15 and the IC 16 are aligned in plan view, and the present disclosure is not limited to this layout. A more compact oscillation device can be used by employing a layout in which a crystal oscillator overlaps an IC. This makes it possible to miniaturize the electronic watch.

In the embodiments described above, the first protrusions and the second protrusions have a circular cylinder shape, a triangular prism shape, and a wall shape, and the shape and number are not limited to these. It suffices that the circuit board be clamped at clamping positions at a predetermined distance from the oscillation device.

For example, the first protrusion 35*w* and the second protrusion 36*w* of the second embodiment are wall shaped protrusions, and the present disclosure is not limited to this. It is sufficient for the first protrusions of a wall shape to have the length A1 at a position facing the clamping position, without limiting the length at the positions not facing the clamping position. The first protrusion 35*w* and the second protrusion 36*w* may have an arch shape in which lengths at positions not facing the clamping positions are short. It is also possible to form a convex shape only at a position facing the clamping position, and to have the convex shape to have the length A1. In this case as well, the first protrusion 35*w* and the second protrusion 36*w* can clamp the circuit board 20 at the clamping positions.

It is sufficient for the lengths in the Z direction of the gaps 37*a* and 37*b* to have the oscillation device 10 avoid abutting against a member disposed in the Z direction when the oscillation device 10 oscillates under an impact such as an external force, and a face facing the second face 22 of the circuit board 20 may be curved, stepped, or the like to set the lengths in the Z direction of the gaps 37*a* and 37*b* to be not less than the length A1.

In the embodiments described above, the first face 21 is in the +Z direction, and the first face 21 is not limited to this. The first face 21 on which the oscillation device 10 is mounted is provided in the −Z direction, and the length of the first protrusion 35 is set to the length A2 and the length of the second protrusion 36 is set to the length A1, to thus secure the gaps 37*a* and 37*b* around the oscillation device 10. This makes it possible to achieve the same advantageous effects as in the embodiments described above.

In the plurality of clamping positions at the circuit board 20, the predetermined distance from the outer edge of the oscillation device 10 may be modified in accordance with a size and weight of the oscillation device. It is sufficient for the oscillation device, when oscillating by an impact such as an external force, to not abut against the member disposed in the Z direction.

The electronic watch of the present disclosure is not limited to each of the above-described embodiments, and the embodiments can be used as appropriate in combination. For example, the first protrusion 35 of the first embodiment and the second protrusion 36*b* of the third embodiment may be used to clamp the circuit board 20. The first protrusions 35 and 35*w* of the second embodiment and the second protrusions 36*a* and 36*b* of the third embodiment may also be used to clamp the circuit board 20. Even with these configurations, it is possible to provide an electronic watch with high precision that hardly has an influence derived from an impact such as a pressing force or a dropping on the crystal oscillator.

In each of the above-described embodiments, the numbers of first and second protrusions are, but not limited to, an identical number. The number of the second protrusions may be greater than the number of the first protrusions. In this case, a plurality of the second protrusions are arranged to avoid overlapping, in projection view in the +Z direction, with the oscillation device 10. Then, the first protrusions and the second protrusions are caused to clamp the circuit board 20 at three or more clamping positions. Alternatively, the number of the first protrusions may be greater than the number of the second protrusions. Such a configuration enables to stably support the circuit board 20, contributing to a stable operation of the crystal oscillator 15.

Further, in the second embodiment, the configuration is employed in which the clamping positions 232 and 233 of the circuit board 20 are clamped between the first protrusion 35*w* and the second protrusion 36*w*, and the present disclosure is not limited to this. A configuration may also be employed in which the clamping positions 232 and 233 are clamped between the two pieces of the first protrusions 35 and one piece of the second protrusion 36*w*. Alternatively, a configuration may also be employed in which one piece of the first protrusion 35*w* and a plurality of the second protrusions 36 clamp the clamping positions 232 and 233. Such a configuration enables to achieve a stable clamping operation and a weight reduction of the first member including the first protrusions.

Moreover, the clamping positions of the circuit board 20 that the first protrusion 35*w* or the second protrusion 36*w* clamp may be provided in three or more. In this case, a configuration may be employed in which one piece of the first protrusion 35*w* or one piece of the second protrusion 36*w* is used to clamp the circuit board 20.

Each of the above-described embodiments employs the configuration in which the crystal oscillator 15 and the IC 16 are housed in the package 11, and the present disclosure is not limited to this configuration. It suffices that the crystal oscillator 15 and the IC 16 be arranged in the region B in FIG. 5. In this case, it is sufficient for a gravity center of a virtual rectangle shape including the crystal oscillator 15 and the IC 16 to overlap with the region B, when viewed in plan view from the +Z direction. Such a configuration enables to achieve equivalent advantageous effects only by devising an arrangement of existing components without designing the IC 16 that is renewed. However, it is desirable that a distance between the crystal oscillator 15 and the IC 16 be short.

What is claimed is:

1. An electronic watch, comprising:

an oscillation device including a package in which an oscillator and a watch control integrated circuit are housed;

a circuit board having an elastic function, the circuit board including a first face and a second face having a front-back relationship with the first face;

a first member disposed to face the first face and provided with a plurality of first protrusions; and a second member disposed to face the second face and provided with a second protrusion facing the first protrusion with the circuit board interposed therebetween, wherein the oscillation device is mounted at the first face of the circuit board, a plurality of clamping positions at a predetermined distance in an outward direction from an outer edge of the oscillation device are clamped between the first protrusion and the second protrusion, A1>P1>A2>0, where A1 is a length of the first protrusion, A2 is a length of the second protrusion, and P1 is a thickness of the oscillation device, and a gap is formed on a side of the first face of the circuit board so that a minimum distance between the first face and the first member is not less than the length A1 and a gap is formed on a side of the second face of the circuit board so that a minimum distance between the second face and the second member is not less than the length A2.

2. An electronic watch, comprising:

an oscillation device including a package in which an oscillator and a watch control integrated circuit are housed;

a circuit board having an elastic function, the circuit board including a first face and a second face having a front-back relationship with the first face;

a first member provided with a plurality of first protrusions;

a second member provided with a second protrusion facing the first protrusion with the circuit board interposed therebetween;

a third member disposed to face the first face; and a fourth member disposed to face the second face, wherein a plurality of clamping positions at a predetermined distance in an outward direction from an outer edge of the oscillation device are clamped between the first protrusion and the second protrusion, $A1>P1>A2>0$, where A1 is a length of the first protrusion, A2 is a length of the second protrusion, and P1 is a thickness of the oscillation device, and a gap is formed on a side of the first face of the circuit board so that a minimum distance between the first face and the third member is not less than the length A1 and a gap is formed on a side of the second face of the circuit board so that a minimum distance between the second face and the fourth member is not less than the length A2.

3. The electronic watch according to claim 1, wherein the plurality of clamping positions are provided and the number of the clamping positions is at least three, and the clamping positions are arranged such that a region formed by connecting the plurality of clamping positions overlaps with a gravity center of the oscillation device.

4. The electronic watch according to claim 1, wherein one first protrusion and the second protrusion clamp the plurality of clamping positions.

5. The electronic watch according to claim 1, wherein the first protrusion and one second protrusion clamp the plurality of clamping positions.

6. The electronic watch according to claim 1, wherein the first member is constituted by a plurality of first constituent members, and the first protrusion is provided at the plurality of first constituent members.

7. The electronic watch according to claim 1, wherein the second member is constituted by a plurality of second constituent members, and the second protrusion is provided at the plurality of second constituent members.

8. The electronic watch according to claim 1, wherein the circuit board is a flexible substrate.

* * * * *